United States Patent [19]

Yoshida

[11] Patent Number: 4,958,189

[45] Date of Patent: Sep. 18, 1990

[54] AUTOMATIC EXPOSURE CONTROL SYSTEM OF IMAGE DUPLICATING APPARATUS

[75] Inventor: Keiji Yoshida, Aichi, Japan

[73] Assignee: Minolta Camera Kabushiki Kaisha, Osaka, Japan

[21] Appl. No.: 418,912

[22] Filed: Oct. 5, 1989

Related U.S. Application Data

[63] Continuation of Ser. No. 123,938, Nov. 23, 1987, abandoned.

[30] Foreign Application Priority Data

Nov. 28, 1986 [JP] Japan ..... 61-285386

[51] Int. Cl.[5] ..... G03G 21/00

[52] U.S. Cl. ..... 355/208; 355/233; 355/243

[58] Field of Search ..... 355/233, 243, 208, 55, 355/68, 69

[56] References Cited

U.S. PATENT DOCUMENTS

| | | | |
|---|---|---|---|
| 4,514,080 | 4/1985 | Matsuzawa et al. | 355/8 X |
| 4,573,787 | 3/1986 | Sanbayashi | 355/55 X |
| 4,583,839 | 4/1986 | Suzuki | 355/14 R |
| 4,627,712 | 12/1986 | Usami | 355/14 E X |
| 4,659,209 | 4/1987 | Yamada | 355/55 X |
| 4,707,114 | 11/1987 | Aoki | 355/14 E X |
| 4,714,945 | 12/1987 | Fujiwara et al. | 355/14 E X |
| 4,737,819 | 4/1988 | Taniguchi | 355/14 E |

*Primary Examiner*—A. T. Grimley
*Assistant Examiner*—Robert Beatty
*Attorney, Agent, or Firm*—Price, Gess & Ubell

[57] ABSTRACT

An image duplicating apparatus including an optical exposure lamp by which a document bearing images is to be scanned by illumination with light, a photosensitive drum on which the images on the document are to be reproduced, a slot through which the light reflected from the document is to be passed toward the drum, and an automatic exposure control system which detects the density of the images on the document from the intensity of the light passed through the slot. The automatic exposure control system produces a first signal representative of the detected image density and produces in response to the first signal a second signal indicative of whether or not the illumination value is adjustable in a real-time automatic exposure control mode. The exposure lamp is responsive to the first and second signals such that, when the second signal indicates that the illumination value is adjustable in the real-time automatic exposure control mode, the exposure lamp is activated to illuminate the document with an illumination value variable with the first signal and, when the second signal indicates that the illumination value is not adjustable in the real-time automatic exposure control mode, the exposure lamp preliminarily scans the document for producing the first signal and determining the illumination value on the basis of the first signal whereupon the exposure lamp is activated to illuminate the document with the illumination value thus determined.

8 Claims, 9 Drawing Sheets

A

Σ SI
S09
S̄I ← Σ SI/21
S10
S11
SI > Vo
NO
YES
S12
S14
PRE-MONITORED CONTROL MODE SELECTED
REAL-TIME CONTROL MODE SELECTED
Sv ← S̄I
S13
SCAN
S15
S16
SCANNED
NO
YES
S17
NO
LAST CYCLE OVER
YES
END

AUTOMATIC EXPOSURE CONTROL SYSTEM OF IMAGE DUPLICATING APPARATUS

This is a continuation of Ser. No. 123,938, filed Nov. 23, 1987, now abandoned.

FIELD OF THE INVENTION

The present invention relates to an electrographic image duplicating apparatus and, more particularly, to an automatic exposure control system for use in such an image duplicating apparatus.

BACKGROUND OF THE INVENTION

In an electrographic image duplicating apparatus, the images on an original document are optically scanned by illumination with a wide beam of light so that the light incident on the document is modulated depending on the patterns of the images exposed to light. The light reflected from the document and thus carrying information representative of the images scanned is projected onto the photosensitive peripheral surface of a rotating drum, as well known in the art. The images on an original document may be denser in one distinct area than in another of the document. For this reason, the intensity of light (herein referred to as illumination value) with which the document is to be illuminated is regulated upon detection of the image density of the document. The images on the document can thus be reproduced with uniform density distribution without respect to the density distribution of the original images.

An electrographic image duplicating apparatus is therefore equipped with an automatic exposure control system which is operative to reduce the illumination value in response to document areas with low density so that the images reproduced from such areas are sufficiently clear and legible on the resultant output of duplication. In response to a document area with denser images contiguous to a background area denser than white, the automatic exposure control system operates to increase the illumination value so that the background area may not become "foggy" on the resultant output. Automatic exposure control systems to achieve these functions are largely broken down to two major categories, one being of the real-time automatic exposure control type and the other being of the premonitored automatic exposure control type. Systems of the real-time automatic exposure control type are used more frequently in low- to medium-speed image duplicating apparatus while those of the pre-monitored automatic exposure control type find typical applications in high-speed image duplicating apparatus.

A real-time automatic exposure control system, an example of which is disclosed in Japanese Provisional Patent Publication (Kokai) No. 57-124374, uses a slot through which to detect the quantity of the light reflected from a row area of the document to be duplicated. The quantity of light thus detected is converted into a corresponding electric signal to regulate the illumination value, viz., the intensity of the light to be emitted from an exposure lamp for the optical scanning of the document. A photodiode is typically used as the photoelectric transducer to detect the quantity of the light reflected from the document.

The illumination value for the exposure of the images on a document is thus regulated on a real-time basis through detection of the quantity of light reflected from the document being scanned. In this real-time automatic exposure control system, however, a problem is encountered in that the exposure lamp used for the irradiation of the document inevitably has a considerable amount of time lag in responding to the control signal produced upon detection of the reflected light. Tests have revealed that such a time lag is of the order of tens of milliseconds in contrast to the response time of the order of microseconds of the photodiode used as the photoelectric detector.

FIG. 1A of the drawings shows an example of a document 20 having distinct black row areas 22 contiguous to less dense areas 24 bearing distributed image patterns represented by rows of letters "A" and "B". When such a document 20 is optically scanned in the direction of arrow S in an image duplicating apparatus equipped with a real-time automatic exposure control system, the rows of images immediately subsequent to the black row areas 22 may be blanked out in the resultant duplication output 20' as indicated at 26 in FIG. 1B. Such blankout has occurred because of the fact that the exposure lamp can not respond to the shifts from the signal resulting from the light reflected from the black row areas 22 to the signal resulting from the light reflected from the adjacent image-bearing areas 24. The rows of the image-bearing areas 24 directly contiguous to the distinct black row areas 22 are irradiated with an illumination value which has been increased in response to the black row areas 22 and fail to be reproduced due to the large amount of light incident on these particular rows. This problem is the more pronounced where original documents have even higher contrasting distinct image areas and the scanning speeds become higher.

On the other hand, a pre-monitored automatic exposure control system operates to preliminarily scan the whole area of an original document to monitor the total density distribution of the document and determine the illumination value to be used for the real scanning of the document. Two scanning cycles are thus used for the duplication of a document, one for the preliminary monitoring of the density distribution and the other for the copying of the document. An example of such a pre-monitored automatic exposure control system is disclosed in Japanese Provisional Patent Publication (Kokai) No. 54-002134. In this pre-monitored automatic exposure control system, the illumination value to be used for the real scanning of the document to be duplicated is determined on the basis of either the average value or the maximum or minimum value of the density detected of the document. The illumination value thus determined of an original document is maintained valid throughout the scanning cycle for the duplication of the particular document and is known to be advantageous especially for high-speed copying. Such an illumination value is however inadequate for properly reproducing a document having distinct image-bearing areas with contrastingly different density levels such as, for example, a document having an area bearing rows of letters and a darker area bearing a photograph.

A pre-monitored automatic exposure control further has a drawback in that the system uses the preliminary scanning of the document and for this reason necessitates an added amount of time for a step which per se does not lend itself to yielding an actual duplication output. Such an added amount of time required for copying operation may as a matter of fact cause the user to have the impression that a pre-monitored automatic exposure control mode or system calls for a prolonged period of time for copying. Such a circumstance will not be very serious for a user who makes a practice of producing a number of copies on a high-speed machine, but would develop into a problem for a user who ordinarily produces a few copies on a low-to medium-speed machine.

SUMMARY OF THE INVENTION

It is, accordingly, an important object of the present invention to provide an electrographic image duplicating apparatus equipped with an improved automatic exposure control system capable of properly controlling the illumination value through detection of the density distribution of an original document.

It is another important object of the present invention to provide an electrographic image duplicating apparatus having an improved automatic exposure control system which is capable of controlling the illumination value without wasting any time for a step which will not lend itself to yielding an output of duplication.

Yet, it is another important object of the present invention to provide an electrographic image duplicating apparatus having an improved automatic exposure control system which selectively uses two different modes of control which consist of both the real-time and premonitored exposure control modes.

In accordance with the present invention, there is provided an electrographic image duplicating apparatus including optical scanning means by which a document bearing images is to be scanned by illumination with light, a photosensitive record medium on which images on a document are to be reproduced, optical scanning means of the slot exposure type by which the images on the document are to be scanned by illumination with light and are to be projected onto the record medium through a predetermined path of light, and an automatic exposure control system which comprises (a) detecting means located in the path of light for detecting the density of the images on the document from the intensity of the light reflected from the document and producing a first signal representative of the detected image density, (b) activating means operative to activate the scanning means to illuminate the document, (c) discriminating means for producing a second signal indicative of whether or not the illumination value is adjustable in a real-time automatic exposure control mode, and (d) control means responsive to the first and second signals for controlling the scanning means and the activating means whereby, when the second signal indicates that the illumination value is adjustable in the real-time automatic exposure control mode, the activating means activates the scanning means so that the scanning means illuminates the document with an illumination value variable with the first signal and, when the second signal indicates that the illumination value is not adjustable in the real-time automatic exposure control mode, the scanning means preliminarily scans the document for enabling the detecting means to produce the first signal and determining the illumination value on the basis of the first signal whereupon the activating means activates the scanning means so that the scanning means illuminates the document with the illumination value thus determined.

In accordance with another outstanding aspect of the present invention, there is provided an electrographic image duplicating apparatus including optical scanning means of the slot exposure type by which the images on the document are to be reproduced by illumination with light and are to be projected onto the record medium through a predetermined path of light, and an automatic exposure control system which comprises (a) detecting means located in the path of light for detecting the density of the images on the document from the intensity of the light reflected from the document and producing a first signal representative of the detected image density, (b) activating means operative to activate the scanning means to illuminate the document with an illumination value variable in a real-time automatic exposure control mode in which the illumination value is varied substantially on a real-time basis depending on the first signal or in a pre-monitored automatic exposure control mode in which the illumination value is preliminarily fixed at a value determined on the basis of the first signal, (c) first control means operative during a multi-cycle copying operation for controlling the activating means to activate the scanning means in the real-time automatic exposure control mode for the first copying cycle, (d) discriminating means which is responsive to the first signal produced during the first copying cycle and which is operative to produce a second signal indicative of whether or not the illumination value is adjustable in the real-time automatic exposure control mode, and (e) second control means responsive to the second signal and operative during a copying operation subsequent to the first copying cycle for controlling the activating means to activate the scanning means in either the real-time automatic exposure control mode or the pre-monitored automatic exposure control mode depending on the second signal.

More specifically, whether or not the illumination value is adjustable in a real-time automatic exposure control mode is determined by the discriminating means and depends on whether or not the pieces of data collected with the first signal, which is produced repeatedly in response to consecutive row areas of the document scanned in a predetermined direction include a data indicating that the detected image density is higher than a predetermined reference value. A data representative of such an image density higher than the predetermined reference value indicates that the document scanned has a highly dense area similar to the black row areas 22 of the document shown in FIG. 1A and that the quantity of light to be emitted from the scanning means, or an exposure lamp, could not be promptly varied in response to a less dense area contiguous to such a highly dense area.

An automatic exposure control system according to the present invention may further include magnification/reduction ratio control means by which the images on the document are to be magnified or reduced in a variable ratio on the record medium. In such a duplicating apparatus, the discriminating means may be operative to produce the second signal depending on whether the selected magnification/reduction ratio is larger or smaller than a predetermined critical value. In this instance, the real-time automatic exposure control mode is preferably used for scanning at low speeds as during magnified copying and the pre-monitored automatic exposure control mode is used for scanning at high speeds as during reduced copying. The critical value of the magnification/reduction ratio at which a shift is to occur between the two modes of control can therefore be fixed depending on, for example, the response characteristics of the exposure lamp. It is thus preferable that the real-time automatic exposure control mode be used when a magnification/reduction ratio is selected which is lower than such a critical value and the premonitored automatic exposure control mode is used when the selected magnification/reduction ratio is higher than the critical value so that a constantly proper illumination value can be used for the scanning of the document to be duplicated.

BRIEF DESCRIPTION OF THE DRAWINGS

The features and advantages of an automatic exposure control system according to the present invention will be more clearly appreciated from the following description taken in conjunction with the accompanying drawings in which.

DESCRIPTION OF THE PREFERRED EMBODIMENTS

Figure 1A:
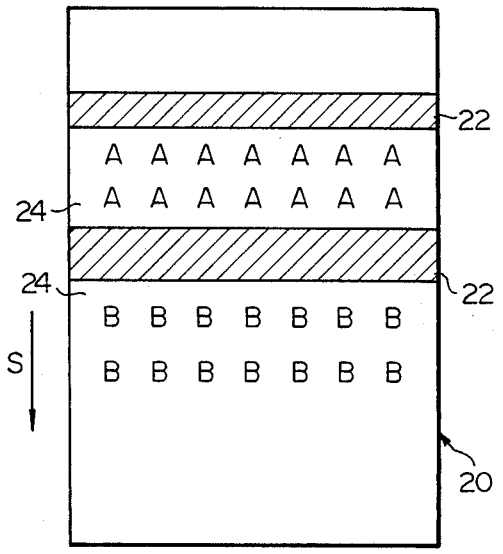
FIG. 1A is a plan view showing an example of the image-bearing area pattern on a document.
Figure 1B:
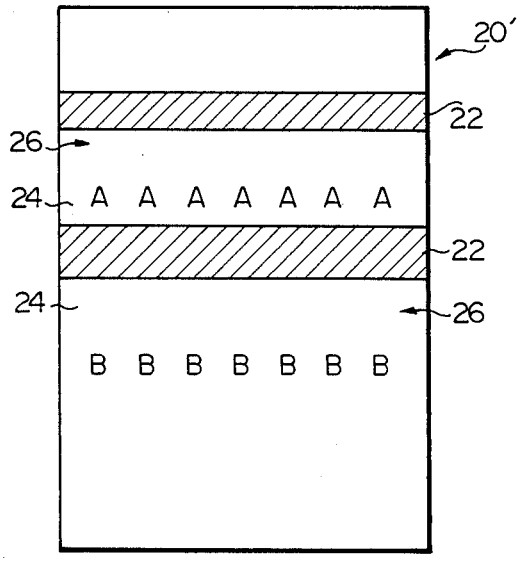
FIG. 1B is a plan view showing an example of the image pattern which may be reproduced on a copy sheet from the image-bearing area pattern illustrated in FIG. 1A.
Figure 2:
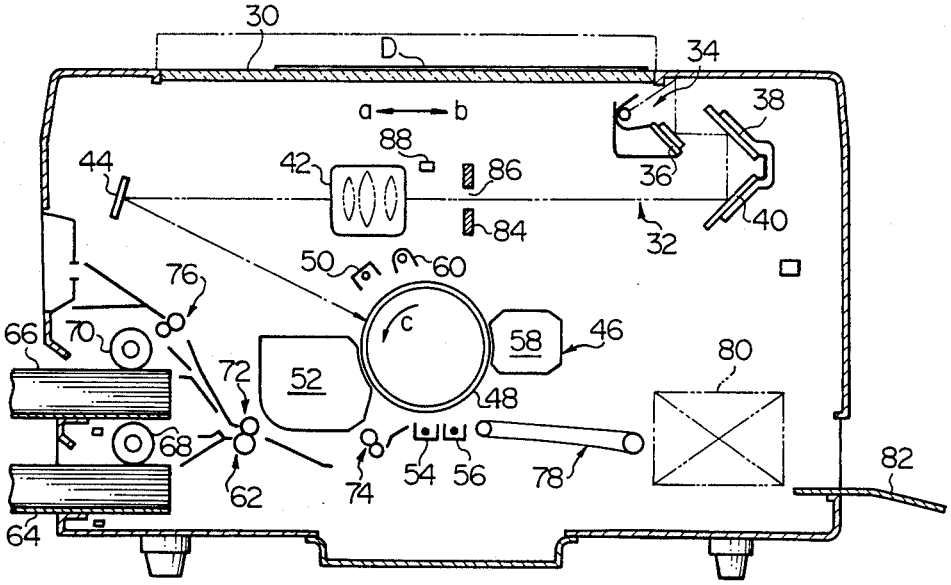
FIG. 2 is a side elevation view showing the general mechanical construction and arrangement of a preferred embodiment of an automated image duplicating apparatus according to the present invention.

As shown in FIG. 2, an image duplicating apparatus embodying the present invention comprises a housing having an upper panel portion provided in part by a transparent document table 30. A sheet of document D bearing images to be reproduced is to be placed on this document table 30.

An optical scanning system 32 is of the slot exposure type and comprises an exposure lamp 34 from which a wide beam of light is incident on and reflected from the lower face of the document D on the table 30. The light reflected from the sheet D is incident onto an object mirror 36 and is re-directed rearwardly therefrom. The lamp 34 and object mirror 36 are movable together along the document table 30 as indicated by arrows a and b. The light reflected from the object mirror 36 is re-directed toward a mirror 38, which further re-directs the light downwardly toward another mirror 40. The mirrors 38 and 40 are also movable along the document table 30 into and out of predetermined home positions indicated by full lines. From the mirror 40, the light travels forwardly along the document table 30 and is passed through an image magnification/reduction lens unit 42 to a projecting mirror 44. It is herein assumed that the lamp 34 and object mirror 36 implement, in combination, a document scanner 34/36 in the scanning system 32. The document scanner 34/36 has, with respect to the document table 30, a predetermined home position which corresponds to one end of the table 30.

The lens unit 42 is movable along the document table 30 independently of the exposure lamp 34 and mirrors 36, 38 and 40 with respect to the table 30. Movement of the lens unit 42 in either direction with respect to the mirror 44 results in a change in the magnification/reduction ratio (hereinafter referred to simply as magnification ratio) of the images to be reproduced. The lamp 34 and mirror 36 are operatively coupled to common drive means and travel at a speed doubling the speed of movement of the mirrors 38 and 40.

The apparatus embodying the present invention further comprises an image reproducing arrangement 46 including a cylindrical drum 48 having a photoconductive peripheral surface. The light incident on the mirror 44 is re-directed toward this image transfer drum 48 and is focused onto the peripheral surface of the drum 48 which is driven for rotation in a direction indicated by arrow c. The lamp 34 and mirror 36 and the mirrors 38 and 40 are driven for movement at speeds proportional to the peripheral speed (V) of rotation of the image transfer drum 48. On the other hand, a change in the position of the lens unit 42 with respect to the peripheral surface of the image transfer drum 48 results in a change in the magnification ratio (N) of the images to be reproduced. In the embodiment herein shown, it is assumed that the lamp 34 and mirror 36 are driven for movement at a speed V/N and the mirrors 38 and 40 at a speed V/2N.

The image reproducing arrangement 46 further includes a charger 50 to sensitize the photoconductive peripheral surface of the drum 48. Posterior to the path of light from the mirror 44 to the drum 48 is located an image developing unit 52 having a stock of toner particles to be applied to the peripheral surface of the image transfer drum 48. Posterior to the developing unit 52 in turn is provided an image transfer charger 54 which is operative to charge the copy sheet so that the toner images on the drum 48 are transferred to the copy sheet. The copy sheet thus having the toner images carried thereon is cleared of charges by a separation charger 56 which is located posterior to the transfer charger 54. There is further provided a drum cleaner unit 58 which removes any residual toner particles from the peripheral surface of the drum 48. Posterior to this cleaner unit 58 in turn is located a charge eraser lamp 60 which irradiates the cleaned peripheral surface of the drum 48 to eliminate the charges which may be left thereon.

A paper feed mechanism 62 is provided in conjunction with paper supply cassettes 64 and 66 detachably fitted to the housing and which have stocks of copy sheets of different sizes encased therein. The paper feed mechanism 62 per se comprises paper feed rollers 68 and 70 associated with the cassettes 64 and 66, respectively, and a pair of guide rollers 72 associated with both of the rollers 68 and 70. Posterior to the developing unit 52 is provided a pair of timing rollers 74 to which is to be transferred a copy sheet passed from the guide rollers 72. The timing rollers 74 are to be driven for rotation at a timing synchronized with the movement of the document scanner 34/36. Indicated at 76 are paper guide rollers which are to guide a paper manually supplied into the apparatus.

A copy-sheet transport belt assembly 78 is positioned posterior to the area where the copy sheet is to be separated from the image transfer drum 48. The copy sheet separated from the drum 48 is thus conveyed through the belt assembly 78 to an image fixing assembly 80 provided at the rear of the transport belt assembly 78. The toner particles carried on the sheet copy are thermally fused and the toner images are fixed on the copy sheet by means of this image fixing assembly 80. The copy sheet released from the image fixing assembly 80 is withdrawn to a paper collect tray 82.

Also provided in the apparatus shown is a sensor for detecting the position of the lens unit 42 with respect to the image transfer drum 48, though not shown in the drawings. The sensor implements means for detecting the magnification ratio which is variable with movement of the lens unit 42 with respect to the drum 48 as previously noted.

Figure 3:
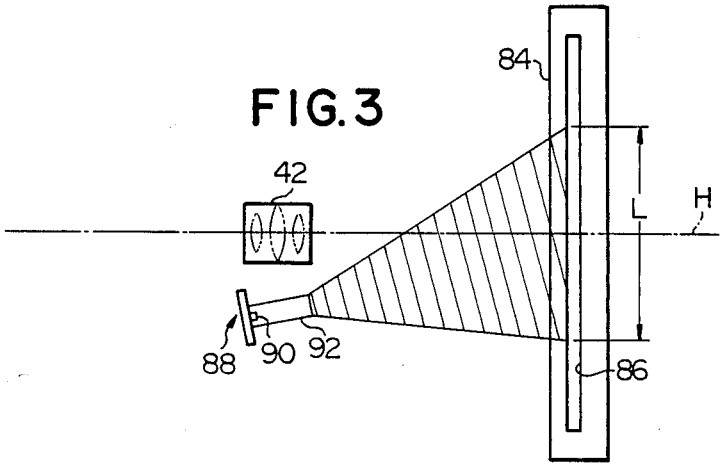
FIG. 3 is a schematic view showing the arrangement in which a light intensity sensor forming part of an automatic exposure control system which may be provided in the apparatus embodying the present invention.

In the apparatus embodying the present invention, there is further provided an apertured member 84 located on the document scanner 34/36 (see FIG. 3). The apertured member 84 is formed with a slot 86 located on the path of light from the document toward the mirror 36 and elongated so that a wide beam of light reflected from the mirror 40 is to be passed therethrough. Anterior to the lens unit 42 in the direction of travel of light is located a light intensity sensor 88 which is adapted to detect the average intensity of the light passed through the slot 86 in the apertured member 84. As illustrated to an enlarged scale in FIG. 3, such a light intensity sensor 88 is herein composed of the combination of a photoelectric transducer element 90 and a light guide member 92. The light guide member 92 is arranged such that a portion of the beam of light passed through the slot 86 in the apertured member 84 along a predetermined length L of the slot 86 is guided toward the light intensity sensor 88 as indicated by a generally triangular area shown hatched in FIG. 3. The photoelectric transducer element 90 is implemented typically by a photodiode. The light intensity sensor 88 thus composed of such a transducer element 90 and the light guide member 92 implements image density detecting means in an automatic exposure control system included in the apparatus embodying the present invention.

Figure 4:
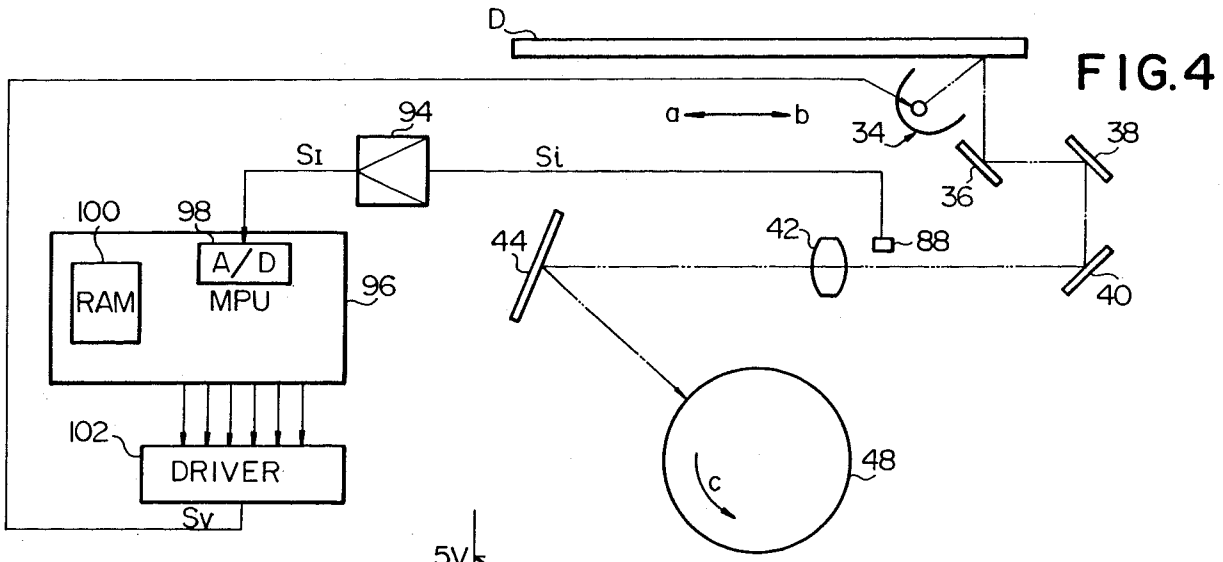
FIG. 4 is a schematic diagram showing the arrangements of the optical scanning system and the automatic exposure control system of the apparatus embodying the present invention.
Figure 5:
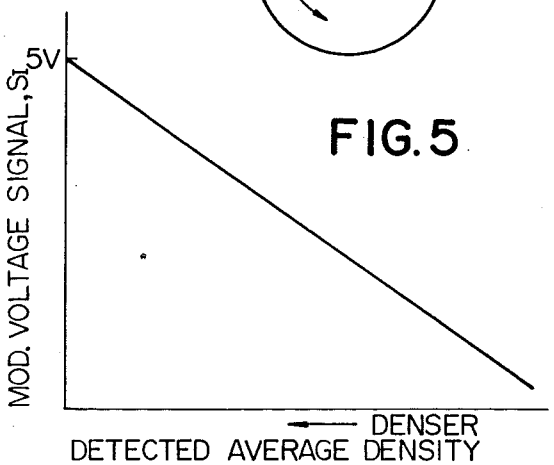
FIG. 5 is a graphic representation of the input/output characteristics of an amplifier incorporated in the automatic exposure control system shown in FIG. 4.

FIG. 4 schematically shows the general arrangements of the optical scanning system 32 and the automatic exposure control system provided in the apparatus embodying the present invention. The intensity of the light incident on the light intensity sensor 88 of the automatic exposure control system is converted into a corresponding analog electric signal $S_i$ by the photoelectric transducer element 90. The signal $S_i$ is amplified into a modulated voltage signal $S_I$ by an amplifier 94 which is assumed to have input/output characteristics indicated in FIG. 5. In FIG. 5, the axis of abscissa represents the average image density which corresponds to the intensity of light detected by the light intensity sensor 88 and converted into the signal $S_i$ by the transducer element 90. The modulated voltage signal $S_I$ thus output from the amplifier 94 is supplied to a control circuit 96 which may be implemented by a single-chip microprocessor including an analog-to-digital converter (A/D) 98 and a random-access memory (RAM) 100. The modulated voltage signal $S_I$ thus input to the control circuit 96 is converted into a digital signal by means of the analog-to-digital converter 98, whereupon the control circuit outputs a signal having "1" or "0" bits corresponding in number to the voltage of the signal $S_I$ input to the control circuit 96. The digital output signal from the control circuit 96 is fed to a lamp driver circuit 102 which is adapted to produce a control signal $S_v$ variable in voltage with the number of the "1" or "0" bits of the supplied digital signal. The control signal $S_v$ in turn is supplied to the exposure lamp 34, which is accordingly activated to produce a quantity of light variable with the signal $S_v$. The illumination value used for the scanning of the document D is in these manners regulated to vary with the image density detected by the light intensity sensor 88.

While the automatic exposure control system in the apparatus embodying the present invention is thus assumed to regulate the illumination value to be achieved by the exposure lamp 34, similar results will be obtained by controlling the bias voltage to be applied to the sleeve (not shown) for the image developing unit 52. Furthermore, the apertured member 84 which has been described to be positioned on the document scanner 34/36 may be located immediately anterior to the area of the image transfer drum 48 onto which the light projected from the mirror 44 is incident, though not shown in the drawings. In this instance, the apertured member 84 may be substituted by any apertured member fixed with respect to the housing of the apparatus.

During a multi-cycle copying operation when a plurality of copies are to be produced in successive cycles, the first copy may be produced with the illumination value regulated in the real-time automatic exposure control mode. When the first copying cycle is complete, it is determined by the control circuit 96 whether the real-time automatic exposure control mode or the pre-monitored automatic exposure control mode is to be used for the copying operation subsequent to the first copying cycle. This decision is made on the basis of control data including those formulated from the modulated voltage signal $S_I$ received by the control circuit 96.

Whether the real-time automatic exposure control mode or the pre-monitored automatic exposure control mode is to be used for the copying operation subsequent to the first copying cycle may be decided depending on whether the exposure lamp 34 will be able to promptly respond to the variation in the control signal $S_v$ supplied from the lamp driver circuit 102. For this purpose, it is tested in the control circuit 96 whether the modulated voltage signal $S_I$ representative of the detected image density of the document D is higher or lower than a reference voltage Vo representing a predetermined image density. If the modulated voltage signal $S_I$ is found to be higher than such a reference voltage Vo, it is deemed that the exposure lamp 34 can not be promptly responsive to the variation in the control signal $S_v$ which may result from the voltage signal $S_I$. In this instance, the control circuit 96 determines to use the pre-monitored automatic exposure control mode for the production of the second to last copies. If the modulated voltage signal $S_I$ is detected to be equal to or lower than the reference voltage Vo, then it is deemed that the exposure lamp 34 can be promptly responsive to the variation in the control signal $S_v$ resulting from the voltage signal $S_I$. In this instance, the control circuit 96 determines to use the real-time automatic exposure control mode for the copying operation subsequent to the first copying cycle. This principle of control will be further described with reference to FIGS. 6A and 6B.

Figure 6A:
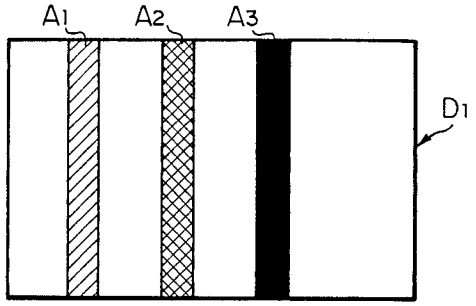
FIG. 6A is a plan view showing another example of the image-bearing area pattern on a document.
Figure 6B:
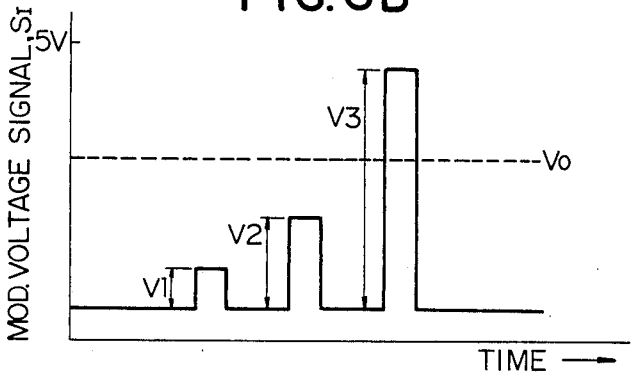
FIG. 6B is a graphic representation of the voltage signals which may be produced in response to the image-bearing area pattern illustrated in FIG. 6A.
Figure 7:
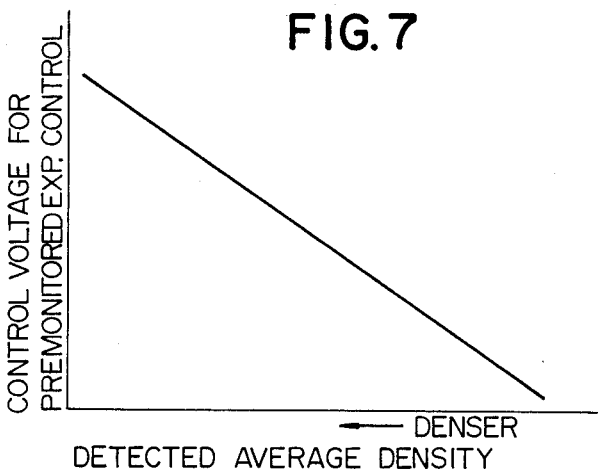
FIG. 7 is a graphic representation of the relationship between the detected average image density of a document and the illumination value to be used in response to the detected average image density during copying in the pre-monitored automatic exposure control mode.

FIG. 6A shows a document $D_1$ having distinct image-bearing areas $A_1$, $A_2$ and $A_3$ which are denser in this sequence. In response to the light reflected from these areas $A_1$, $A_2$ and $A_3$, the amplifier 94 of the automatic exposure control system shown in FIG. 4 will produce voltages $V_1$, $V_2$ and $V_3$, respectively, each as the modulated voltage signal $S_I$ as shown in FIG. 6B. The voltages $V_1$ and $V_2$ are assumed to be lower than the reference voltage Vo and the voltage $V_3$ assumed to be higher than reference voltage Vo. When the modulated voltage signal $S_I$ produced with the document $D_1$ scanned throughout the length of the sheet varies to a voltage level such as level of the voltage $V_3$ higher than the reference voltage Vo, it is determined by the control circuit 96 that the exposure lamp 34 can not respond to the variation in the resultant control signal $S_v$. In this instance, the control circuit 96 further determines to use the pre-monitored automatic exposure control mode for the copying operation subsequent to the first copying cycle. FIG. 7 shows the relationship between the detected average image density and the illumination value to be used in response to the detected average image density during copying in the pre-monitored automatic exposure control mode. As will be readily understood, this relationship corresponds to the relation between the signal $S_i$ produced by the transducer element 90 and the voltage of the control signal $S_v$ produced from the driver circuit 102 in response to the signal $S_i$.

Figure 8A:
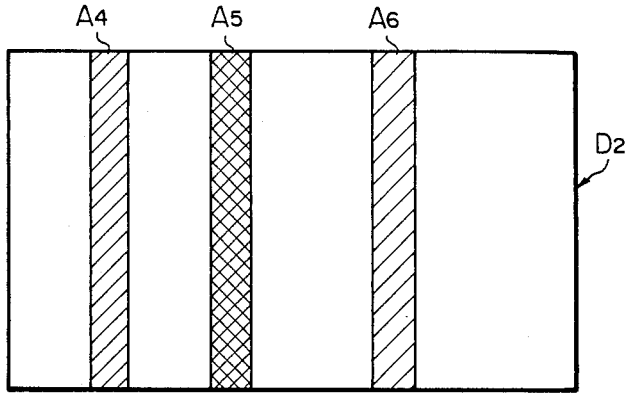
FIG. 8A is a view similar to FIG. 6A but shows still another example of the image-bearing area pattern on a document.
Figure 8B:
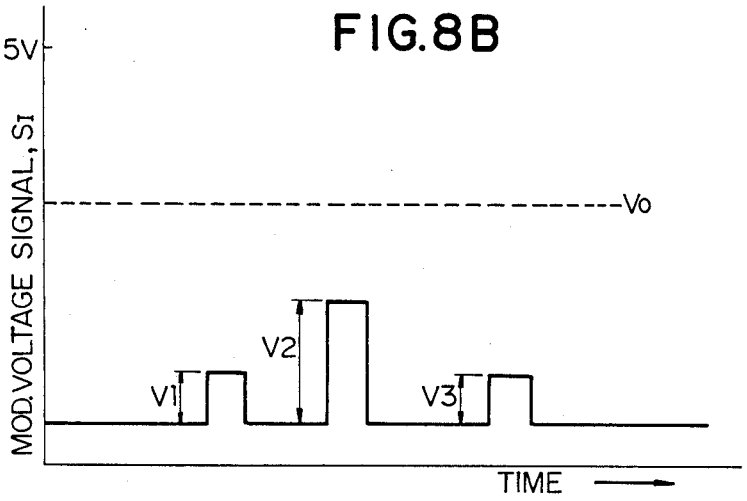
FIG. 8B is a graphic representation of the voltage signals which may be produced in response to the image-bearing area pattern illustrated in FIG. 8A.

FIG. 8A shows another document $D_2$ having a low-density image-bearing area $A_4$, a medium-density image-bearing area $A_5$ and a low-density image-bearing area $A_6$. In response to the light reflected from these distinct image-bearing areas $A_4$, $A_5$ and $A_6$, the amplifier 94 of the automatic exposure control system shown in FIG. 4 will produce voltages $V_4$, $V_5$ and $V_6$, respectively, each has the modulated voltage signal $S_I$ lower than the reference voltage Vo as shown in FIG. 8B. When the modulated voltage signal $S_I$, which is produced with the document $D_2$ scanned throughout the length of the sheet, varies to these voltage levels, it is determined by the control circuit 96 that the exposure lamp 34 can be promptly responsive to the variation in the signal $S_v$ resulting from such a signal $S_I$. In this instance, the control circuit 96 further determines to use the real-time automatic exposure control mode for the copying operation subsequent to the first copying cycle. If desired, however, the pre-monitored automatic exposure control mode similar to that used for the first copying cycle may also be used in lieu of the real-time automatic exposure control mode for the production of the second to last copies.

Figure 9A:
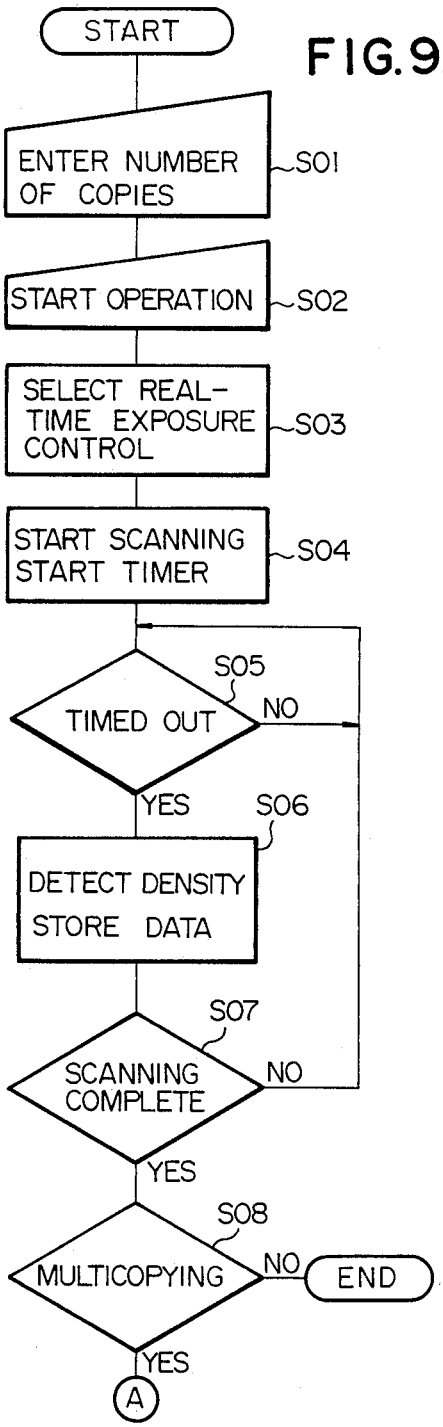
FIGS. 9A and 9B are flowcharts showing the program which may be executed by the control circuit for carrying out the automatic exposure control in the apparatus embodying the present invention.
Figure 9B:
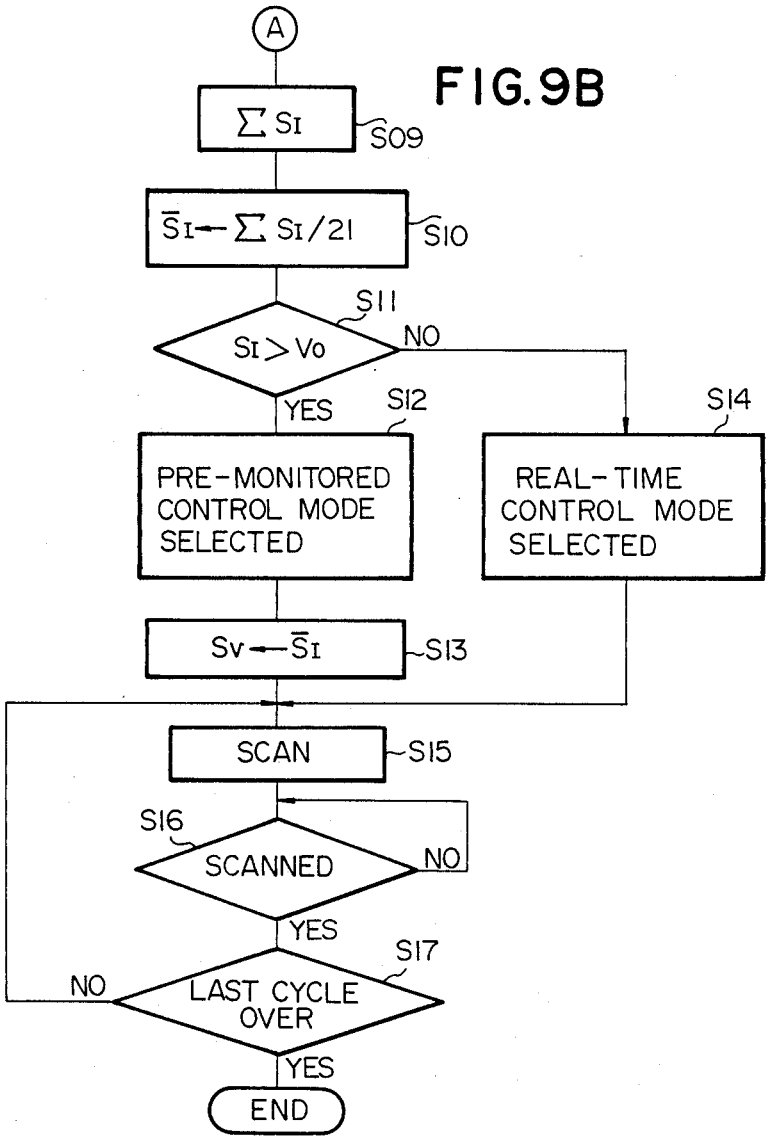

FIGS. 9A and 9B show the program which may be executed by the control circuit 96 for carrying out the automatic exposure control in the apparatus embodying the present invention in accordance with the schedules hereinbefore described.

As shown in FIG. 9A, the program starts with a step S01 at which time the number of the copies desired to be produced for a document D placed on the table 30 is entered at the control panel (not shown) of the apparatus. Thereafter, the apparatus is started into a duplicating operation at a step S02 with a print start switch (not shown) manually depressed. At a step S03, the control circuit 96 selects the real-time automatic exposure control mode as the mode of control to be used for the first copying cycle. The document scanning operation is then started at a step S04 so that the document D on the table 30 is irradiated by means of the scanner 34/36 with the illumination value determined in the real time automatic exposure control mode and the intensity of the light passed through the slot 86 is detected by the light intensity sensor 88. At this step S04 is also started the internal timer of the microprocessor implementing the control circuit 96 for producing time interval signals repeatedly in predetermined cycles.

The length of the document D, viz., the distance over which the scanner 34/36 is to travel for scanning the document D is herein assumed to be 21 cm and the image transfer drum 48 assumed to be driven for rotation at a circumferential speed of 20 cm/sec. In this instance, the scanner 34/36 may be driven to travel forward at a speed of 20 cm/sec along the document table 30. The light intensity sensor 88 is designed to produce the output signal $S_i$ indicative of the detected average image density every time the document scanner 34/36 travels a distance of 1 cm. The internal timer started at the step S4 is thus assumed to produce the time interval signals in cycles of 1/20 second. As discussed previously, the signal $S_i$ produced by the light intensity sensor 88 is modulated into the voltage signal $S_I$ having the characteristics shown in FIG. 5. The intervals at which this modulated voltage signal $S_I$ is to be output is timed at a step S05 so that, each time the signal $S_I$ is issued, the data representative of the image density indicated by the signal $S_I$ is stored into the RAM 100 in the control circuit 96 at a step S06. Such data are stored into the RAM 100 a total of 21 times until the scanner 34/36 travels throughout the length of the document D and, when it is determined at a step S07 that the storage of the data is complete, it is questioned at a step S08 whether or not the current copying operation is a multi-cycle copying operation to produce two or more copies. If it is found that this is the case, the program proceeds through a connector "A" to the series of steps shown in FIG. 9B. If the answer for the step S08 is given in the negative, then the program comes to an end.

If a second and possibly more copies are to be produced, the pieces of data which have been stored into the RAM 100 are read out and are processed to calculate the sum of the detected average densities of twenty one row areas of the document D at a step S09. The sum thus calculated is divided by 21 at a step S10 to obtain the mean value of the twenty one detected average densities. The step S10 is followed by a decision step S11 at which it is tested whether or not any one of the twenty one pieces of data read from the RAM 100 include any data indicating a density higher than a predetermined reference value which is represented by the previously mentioned reference voltage Vo. If it is found that there is at least one piece of such data, the pre-monitored automatic exposure control mode is selected at a step S12 and, at a subsequent step S13, the illumination value, viz., the voltage of the control signal $S_v$ to be used for the production of the second to last copies is determined on the basis of the mean value calculated at the preceding step S10. If it is determined at the step S11 that there is no data indicating a density higher than the reference value (Vo), the real-time automatic exposure control is selected at a step S14.

With either the pre-monitored automatic exposure control mode or the real-time automatic exposure control mode selected at the step S13 or S14, respectively, the scanning operation for production of the second to last copies is started at a step S15 until it is finally confirmed through steps S16 and S17 that the desired total number of copies have been produced.

In the embodiment of the present invention as has hereinbefore described, the first copy is to be produced using the real-time automatic exposure control. If, in this instance, the original document happens to be of a nature similar to that shown in FIG. 6A and could not be reproduced properly by the real-time automatic exposure control, the first copy resulting from such a document would be an unacceptable one. It is however empirically known that only an extremely few documents have highly dense image areas extending throughout the widths of the documents like the area $A_3$ of the document shown in FIG. 6A. Thus, if a density data resulting from a highly dense area of an ordinary document may indicate a density higher than the reference value, the deviation of the density indicated by the data from the reference value is of a practically permissible degree and the copies produced from such documents are in most cases acceptable in legibility although the qualities of the copies will not be fully satisfactory. This means that the described preferred embodiment of the present invention is advantageous for producing high-quality copies from any ordinary documents without having recourse to the use of the time-consuming preliminary scanning step required in carrying out the pre-monitored automatic exposure control mode.

Figure 10:
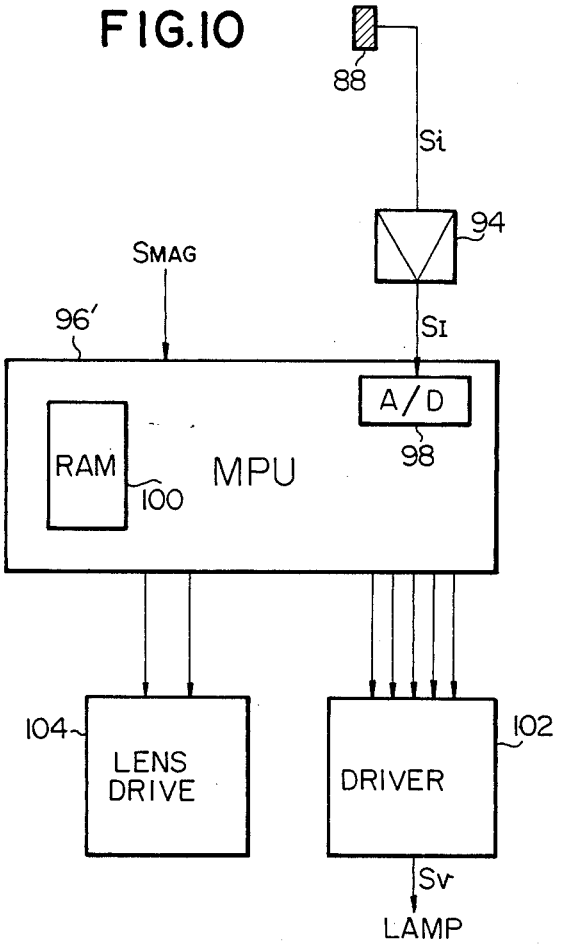
FIG. 10 is a schematic diagram showing an automatic exposure control system which forms part of a second preferred embodiment of an apparatus according to the present invention.

FIG. 10 shows an automatic exposure control system which forms part of a second preferred embodiment of an apparatus according to the present invention. The automatic exposure control system herein shown is particularly useful in a duplicating apparatus having image magnification/reduction capabilities. The construction and arrangement of an electrographic image duplicating apparatus having such capabilities is taught in, for example, U.S. Pat. No. 4,644,499 to Shibasaki et al. and will not be herein described.

As discussed previously, the variation in the quantity of light to be emitted from the exposure lamp 34 is responsive not only to changes in the density distribution but also to changes in the speed at which the scanner 34/36 including the lamp 34 is to be driven for movement during scanning operation. As also noted, the speed (V/N) of movement of the scanner 34/36 is varied with the selected magnification ratio (N) for copying in a duplicating apparatus having the image magnification/reduction capabilities. The scanning speed is decreased for magnified copying and is increased for reduced copying. In a duplicating apparatus of this type, therefore, it is desirable that the real-time automatic exposure control mode be used for scanning at low speeds (as during magnified copying) and the pre-monitored automatic exposure control mode used for scanning at high speeds (as during reduced copying). The critical value of the magnification or reduction ratio at which a shift is to occur between the real-time and pre-monitored automatic exposure modes is typically the one-to-one ratio but may be selected arbitrarily depending on the response characteristics of the exposure lamp. The second embodiment of the present invention is adapted to realize these principles of control over the illumination value in a duplicating apparatus having the image magnification/reduction capabilities.

Now, the electrographic image duplicating apparatus shown in FIG. 10 comprises a control circuit 96' which is also implemented by a microprocessor including an analog-to-digital converter 98 and a RAM 100 and having an input port connected through an amplifier 94 to the light intensity sensor 88. The amplifier 94 is assumed to be similar in function to its counterpart in the arrangement of FIG. 4 and is operative to convert a supplied signal $S_i$ into a modulated voltage signal $S_I$ in accordance with the input/output characteristics shown in FIG. 5. In the automatic exposure control system herein shown, the control circuit 96' further has an input terminal connected to a source (not shown) of a signal $S_{MAG}$ indicative of a selected magnification ratio. In response to the magnification ratio signal $S_{MAG}$, the control circuit 96' selects either the real-time automatic exposure control mode or the pre-monitored automatic exposure control mode and enables the lamp driver circuit 102 to output a control signal $S_v$ variable with or fixed depending upon the supplied control signal $S_I$.

The magnification ratio is entered by the user from a control panel (not shown) and a signal representative of the ratio is transferred to the control circuit 96. The magnification ratio signal $S_{MAG}$ is also supplied to an actuator 104 for the lens unit 42, which is thus driven for movement in accordance with the signal $S_{MAG}$.

Figure 11:
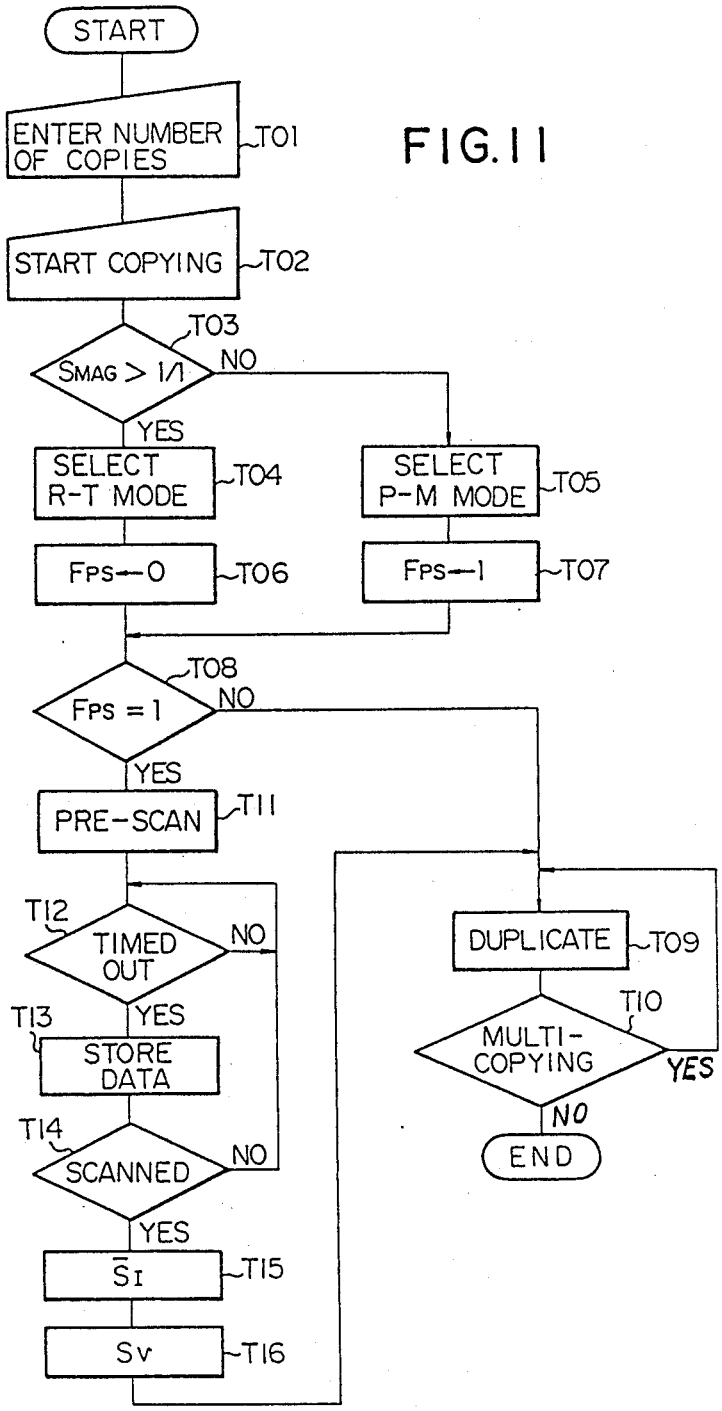
FIG. 11 is a flowchart showing the program which may be executed for carrying out the automatic exposure control in the second preferred embodiment of the present invention.

FIG. 11 shows the program which may be executed by the control circuit 96' for carrying out the automatic exposure control in the second embodiment of the present invention. As shown in FIG. 11, the program starts with a step T01 at which the desired number of copies is entered, whereupon the apparatus is started into duplicating operation at a step T02. It is then confirmed at a step T03 that the supplied magnification ratio signal $S_{MAG}$ is indicative of a magnification ratio larger than a predetermined reference value which is herein assumed to be the one-to-one ratio. If it is found that a magnified copying mode is indicated by the signal $S_{MAG}$, the real-time automatic exposure control mode is selected at a step T04 and, if to the contrary, the pre-monitored automatic exposure control mode is selected at a step T05. When the real-time automatic exposure control mode is selected at the step T04, a flag $F_{ps}$ indicating the pre-monitored automatic exposure control mode is shifted to a logic "0" bit at a subsequent step T06 and when the pre-monitored automatic exposure control mode is selected at the step T05, then the flag $F_{ps}$ is shifted to a logic "1" bit at a subsequent step T07. After the flag $F_{ps}$ is thus shifted to the logic "0" or "1" bit, it is queried at a decision step T08 whether or not the flag $F_{ps}$ is of a logic "1" bit. When it is found at this step T08 that the flag $F_{ps}$ is of a logic "0" bit, the document on the document table 30 is scanned with the illumination value determined in the real-time automatic exposure control mode at a step T09. When the scanning operation is complete, it is decided at a step T10 whether or not the current copying operation is a multi-cycle copying operation to produce two or more copies. If it is found that this is the case, the step T09 is repeated until it is confirmed that the last copying cycle is complete, whereupon the program comes to an end.

When it is found at the step T08 that the flag $F_{ps}$ is of a logic "1" bit calling for the pre-monitored automatic exposure control mode, the document on the document table 30 is preliminarily scanned with a predetermined illumination value at a step T11. At this step T11 is also started the internal timer of the microprocessor implementing the control circuit 96' for producing time interval signals repeatedly in predetermined cycles. The internal timer produces the time interval signals in cycles of, for example, 1/20 second and a voltage signal $S_I$ having the characteristics shown in FIG. 5 is received by the control circuit 96' each time the time interval signal is issued from the timer. The intervals at which the modulated voltage signal $S_I$ is to be input to the control circuit 96' is timed at a step T12 so that, each time the signal $S_I$ is received, the data representative of the image density indicated by the signal $S_I$ is stored into the RAM 100 in the control circuit 96' at a step T13. When it is determined at a step T14 that the scanning operation is complete with a predetermined number of pieces of data stored into the RAM 100, the pieces of data are read out from the RAM 100 to calculated the mean value of the detected average densities at a step T15. The step T15 is followed by a step T16 at which the illumination value, viz., the voltage of the control signal $S_v$ is determined on the basis of the mean value calculated at the step T15. The document on the document table 30 is now scanned with the illumination value determined in the pre-monitored automatic exposure control mode at the step T09. When the scanning operation is complete, it is questioned at the step T10 whether or not the current copying operation is a multi-cycle copying operation. If it is found that this is the case, the step T09 is repeated until it is confirmed that the last scanning operation is complete, whereupon the program comes to an end.

What is claimed is:

1. An electrophotographic image duplicating apparatus, a photosensitive recording medium on which images on a document are to be reproduced, optical scanning means of the slot exposure type by which the images on said document are to be scanned by illumination with light and are to be projected onto said recording medium through a predetermined path of light, and an automatic exposure control system which comprises:

(a) detecting means located in said path of light for detecting the density of the images on said document from the intensity of the light reflected from said document and producing a first signal representative of the detected image density;

(b) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means is preliminarily scanning said document;

(c) automatic discriminating means for determining whether an adequate response time for variation of the scanning means illumination of the scanned images can be accomplished in accordance with the image density represented by the first signal and for producing a second signal indicative of whether or not said illumination value is adjustable in a real-time automatic exposure control mode, and (d) control means for controlling said scanning means and said activating means whereby when said second signal indicates that said illumination value is adjustable in said real-time automatic exposure control mode, said activating means activates said scanning mode, and said real-time automatic exposure control mode, and when said second signal indicates that said illumination value is not adjustable in said real-time automatic exposure control mode, said activating means activates said scanning means in said premonitored automatic exposure control mode.

2. An automatic exposure control system as set forth in claim 1, wherein said automatic discriminating means produces the second signal indicating that said illumination value is not adjustable in said real-time automatic exposure control mode when said first signal indicates that at least one localized area of said document has an image density higher than a predetermined reference value.

3. An electrophotographic image duplicating apparatus, a photosensitive recording medium on which images on a document are to be reproduced, optical scanning means of the slot exposure type by which the images on said document are to be scanned by illumination with light and are to be projected onto said recording medium through a predetermined path of light, and an automatic exposure control system which comprises:

(a) detecting means located in said path of light for detecting the density of the images on said document from the intensity of the light reflected from said document and producing a first signal representative of the detected image density;

(b) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means is preliminarily scanning said document;

(c) first control means operative during a multi-cycle copying operation for controlling said activating means to activate said scanning means in said real-time automatic exposure control mode for the first copying cycle of a multi-cycle copying operation for a signal document;

(d) automatic discriminating means for determining whether an adequate response time for variation of the scanning means illumination of the scanned images can be accomplished in accordance with the image density represented by the first signal and for producing a second signal indicative of whether or not said illumination value is adjustable in said real-time automatic exposure control mode, and (d) second control means responsive to said second signal for controlling said activating means to activate said scanning means in said premonitored automatic exposure control mode during the second copying cycle of operation subsequent to said first copying cycle of operation when the second signal indicates that said illumination value is not adjustable in said real-time automatic exposure control mode, wherein the illumination value is determined on the basis of said first signal produced during said first cycle of copying operation.

4. An automatic exposure control system as set forth in claim 3, wherein said automatic discriminating means produces the second signal indicating that said illumination value is not adjustable in said real-time automatic exposure control mode when said first signal indicates that at least one localized area of said document has an image density higher than a predetermined reference value.

5. An automatic exposure control system for use in an electrophotographic image duplicating apparatus, comprising:

(a) scanning means for scanning images on a document by illumination with light;

(b) detecting means for detecting a density of images on said document by the intensity of the light reflected from the document and producing a first signal representative of the detected image density;

(c) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means is preliminarily scanning said document;

(d) automatic discriminating means for determining whether an adequate response time for variation of the scanning means illumination of the scanned images can be accomplished in accordance with the image density represented by the first signal and for producing a second signal indicative of whether or not said illumination value is adjustable in a real-time automatic exposure control mode, and (e) control means for controlling said activating means to activate said scanning means in said real-time automatic exposure control mode when said second signal indicates that said illumination value is adjustable in said real-time automatic exposure control mode and to activate said scanning means in said premonitored automatic exposure control mode when said second signal indicates that said illumination value is not adjustable in said real-time automatic exposure control mode.

6. An automatic exposure control system for use in an electrophotographic image duplicating apparatus, comprising:

(a) scanning means for scanning images on a document by illumination with light;

(b) detecting means for detecting the density of the images on said document from the intensity of the light reflected from the document and producing a first signal representative of the detected image density;

(c) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means is preliminarily scanning said document;

(d) automatic discriminating means for determining whether an adequate response time for variation of the scanning means illumination of the scanned images can be accomplished in accordance with the image density represented by the first signal and for producing a second signal indicative of whether or not a portion of said document has an image density higher than a predetermined reference value, and (e) control means for controlling said activating means to activate said scanning means in said real-time automatic exposure control mode when said second signal indicates that said portion of said document has an image density lower than said reference value and to activate said scanning means in said premonitored automatic exposure control mode when said second signal indicates that said document has an image density higher than said reference value.

7. An automatic exposure control system for use in an electrophotographic image duplicating apparatus, comprising:

(a) scanning means for scanning images on a document by illumination with light;

(b) detecting means for detecting the density of the images on said document from the intensity of the light reflected from the document and producing a first signal representative of the detected image density;

(c) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means is preliminarily scanning said document;

(d) magnification/reduction ratio selecting means for selecting a magnification/reduction ratio in which the images on said document are to be magnified or reduced;

(e) discriminating means for producing a second signal indicative of whether or not the magnification/reduction ratio selected by said magnification/reduction ratio selecting means is smaller than a predetermined reference value, and (f) control means for controlling said activating means to activate said scanning means in said real-time automatic exposure control mode when said second signal indicates that the magnification/reduction ratio selected by said magnification/reduction ratio selecting means is equal or larger than said predetermined reference value and to activate said scanning means in said premonitored automatic exposure control mode when said second signal indicates that the magnification/reduction ratio selected by said magnification/reduction ratio selecting means is smaller than said predetermined reference value.

8. An automatic exposure control system including a photosensitive recording medium on which images on a document are to be reproduced, optical scanning means of the slot type by which the images on said document are to be scanned by illumination with light and are to be projected onto said recording medium through a predetermined path of light, and an automatic exposure control system which comprises:

(a) detecting means located in said path of light for detecting the density of the images on said document from the intensity of the light reflected from said document and producing a first signal representative of the detected image density;

(b) activating means for activating said scanning means to illuminate said document, said activating means being operable either in a real-time automatic exposure control mode having an illumination value variable on a real-time basis and based on said first signal or in a premonitored automatic exposure control mode in which the illumination value is determined on the basis of said first signal produced while said scanning means preliminarily is scanning said document;

(c) magnification/reduction ratio control means by which the images on said document are to be magnified or reduced in a variable ratio on said recording medium;

(d) discriminating means for producing a second signal indicative of whether or not said illumination value is adjustable in said real-time automatic exposure control mode depending on whether the selected magnification/reduction ratio is larger or smaller than a predetermined critical value, and (e) automatic exposure control means for controlling said activating means whereby when said second signal indicates that said illumination value is adjustable in said real-time automatic exposure control mode, said activating means activates said scanning means in said real-time automatic exposure control mode, and when said second signal indicates that said illumination value is not adjustable in said real-time automatic exposure control mode, said activating means activates said scanning means in said premonitored automatic exposure control mode.

* * * * *